US012352546B2

(12) United States Patent
Hall et al.

(10) Patent No.: US 12,352,546 B2
(45) Date of Patent: Jul. 8, 2025

(54) FIREARM AMMUNITION COMPONENT AND METHOD OF USE

(71) Applicant: Traditional Sporting Goods, Inc., Old Saybrook, CT (US)

(72) Inventors: Thomas F. Hall, Higganum, CT (US); Karl K. Ricker, Brookfield, NH (US); Ryan Nicholas, Scottsdale, AZ (US)

(73) Assignee: Traditional Sporting Goods Inc., Old Saybrook, CT (US)

( * ) Notice: Subject to any disclaimer, the term of this patent is extended or adjusted under 35 U.S.C. 154(b) by 0 days.

(21) Appl. No.: 18/325,666

(22) Filed: May 30, 2023

(65) Prior Publication Data

US 2023/0384070 A1 Nov. 30, 2023

Related U.S. Application Data

(60) Provisional application No. 63/347,361, filed on May 31, 2022.

(51) Int. Cl.
*F42B 14/06* (2006.01)
*F42B 14/02* (2006.01)

(52) U.S. Cl.
CPC ..... *F42B 14/067* (2013.01); *F42B 14/02* (2013.01)

(58) Field of Classification Search
CPC ..... F42B 8/14; F42B 14/02; F42B 14/064; F42B 12/34; F42B 30/02
See application file for complete search history.

(56) References Cited

U.S. PATENT DOCUMENTS 32,293 A * 5/1861 Hotchkiss ..... F42B 14/02 102/525
34,493 A * 2/1862 Havens ..... F42B 14/02 102/525
40,153 A * 10/1863 Billings ..... F42B 14/02 102/525
43,027 A * 6/1864 Hotchkiss ..... F42B 14/064 102/520
451,088 A * 4/1891 Tunnicliff ..... F42B 12/34 102/506
2,382,152 A * 8/1945 Jakobsson ..... F42B 14/064 89/14.6

(Continued)

OTHER PUBLICATIONS

Powerbelts Bullets Catalog 2021.

*Primary Examiner* — Derrick R Morgan
(74) *Attorney, Agent, or Firm* — DeLio Peterson & Curcio LI.C; Robert Curcio

(57) ABSTRACT

A firearm ammunition component comprising a projectile body having a circular cross-section and a central channel on a forward face, a nose portion forward of the projectile body, and a gas check member rearward of the projectile body. The nose includes a curved forward end, a rear end opposite the forward end, and a stabilizing element/band between the forward and rear ends extending radially outwards from at least a portion of the nose. A shank extends from the nose rear end and within the body central channel. The gas check member includes a rearward annular wall portion forming a combustion chamber. The firearm ammunition component is adapted so only the stabilizing element/band contacts the firearm bore, ensuring loading central the bore.

26 Claims, 11 Drawing Sheets

(56) References Cited

U.S. PATENT DOCUMENTS 2,911,911 A * 11/1959 White ..... F42B 14/02 102/439
2,991,719 A * 7/1961 McG. Millar ..... F42B 14/064 102/523
2,991,720 A * 7/1961 Dunlap ..... F42B 14/064 102/523
2,994,274 A * 8/1961 Dunlap ..... F42B 14/064 102/523
2,996,992 A * 8/1961 Critchfield ..... F42B 14/064 102/523
2,998,778 A * 9/1961 Hablutzel ..... F42B 14/064 102/522
3,695,181 A * 10/1972 Bull ..... F42B 14/064 102/522
3,762,332 A * 10/1973 Witherspoon ..... F42B 14/064 102/523
4,015,528 A * 4/1977 Barr ..... F42B 14/064 102/518
4,108,074 A * 8/1978 Billing, Jr. ..... F42B 8/14 264/328.12
4,175,493 A * 11/1979 Daily ..... F42B 14/064 102/520
4,301,737 A * 11/1981 Yuhash ..... F42B 12/06 102/493
4,800,816 A * 1/1989 Meyer ..... F42B 14/064 102/523
5,175,392 A * 12/1992 Denis ..... F42B 30/02 102/516
5,182,419 A * 1/1993 Burnette ..... F42B 14/064 102/523
5,183,963 A * 2/1993 Beaufils ..... F42B 14/00 102/515
5,458,064 A 10/1995 Kearns
5,621,187 A 4/1997 Kearns
6,763,765 B2 7/2004 Crowson
6,895,865 B2 5/2005 Bond
7,444,942 B2 11/2008 Hall
7,726,245 B2 6/2010 Quesenberry et al.
7,827,915 B1 11/2010 Hall et al.
9,146,086 B2 9/2015 Peterson et al.
9,513,092 B2 12/2016 Emary
9,562,754 B2 * 2/2017 Peterson ..... F42B 14/04
9,689,648 B1 * 6/2017 Kostka ..... F42B 12/22
10,443,993 B1 * 10/2019 Chaplin ..... F42B 14/065
10,527,393 B1 * 1/2020 Sapp ..... F42B 12/62
11,313,657 B1 * 4/2022 Agazim ..... F42B 12/78
11,668,549 B2 * 6/2023 Peterson ..... F42B 8/04 42/51
11,959,734 B2 * 4/2024 Wilkes ..... F42B 14/02
2005/0183318 A1 * 8/2005 McGivern ..... F41A 21/00 42/76.01
2006/0027128 A1 * 2/2006 Hober ..... F42B 14/06 102/514
2006/0027130 A1 * 2/2006 Parker ..... F42B 14/02 102/524
2007/0131131 A1 * 6/2007 Stock ..... F42B 12/34 102/510
2011/0048272 A1 3/2011 Hall et al.
2012/0272855 A1 * 11/2012 Rebar ..... F42B 12/34 102/517
2017/0234664 A1 * 8/2017 Golloher ..... F42B 12/367 102/510
2018/0335285 A1 * 11/2018 Gizowski ..... F42B 30/02
2019/0316888 A1 10/2019 Thielen et al.
2021/0254954 A1 * 8/2021 Billings ..... F41A 21/18
2021/0310775 A1 * 10/2021 Mahnke ..... F42B 30/02
2023/0160672 A1 * 5/2023 Gizowski ..... F42B 12/02 244/3.23
2024/0183642 A1 * 6/2024 Gizowski ..... F42B 10/26

* cited by examiner

FIREARM AMMUNITION COMPONENT AND METHOD OF USE

BACKGROUND OF THE INVENTION

1. Field of the Invention

The present invention relates in general to the field of ammunition, including, but not limited to, muzzleloading firearm ammunition.

2. Description of the Related Art

The ammunition used in firearms, including the ammunition of muzzleloading firearms ("muzzleloaders"), has evolved from using round-ball projectiles to sleek, aerodynamic projectiles featuring tapered designs that have vastly improved projectile performance. As it is generally known, most traditional firearm ammunition cartridges are constructed using a metal shell casing (e.g., a brass casing) containing some amount of propellant (e.g, gunpowder, smokeless powder, etc.) in a rearward portion of the cartridge that is sometimes referred to as the cartridge "body." The metal casing of a traditional casing also holds a projectile, or projectile body, in a frontward portion of the cartridge that is sometimes referred to as the cartridge "neck." Gases resulting from the burning of the propellant pressurize radially and expand the metal casing against the wall of the chamber, and push against the base of the projectile, causing the projectile to be expelled from the front of the cartridge and through the barrel of the firearm Unlike the ammunition of cartridge-based firearms, muzzleloaders require the propellant charge and projectile to be loaded separately within the barrel prior to firing. Muzzleloaders are loaded by feeding a propellant charge through the muzzle of the barrel, and subsequently driving the projectile down the barrel to seat it against the propellant charge at the breech end of the barrel.

To ensure proper firing operations, muzzleloading firearms include a projectile in combination with a wad or gas check member between the propellant charge and the projectile. Other muzzleloading firearms utilize containment vessels containing a quantity of propellant. In order to obtain sufficient gas pressure from the combustion of the propellant charge, the outer diameter of the projectile often exceeded the inner diameter of the barrel. In addition to the loading difficulty resulting from the contact between the barrel bore and the projectile, scoring of the projectile during contact with the bore's rifling (tile "lands and grooves") often degrades the performance of the projectile upon firing.

A sabot is a supportive device which surrounds the projectile and engages the barrel of the firearm to hold it in place. Since a sabot is between both the projectile and the barrel, interference can result between the projectile and the barrel which can also affect the performance of the projectile upon firing. Further, ill cases where a sabot does not detach from the projectile upon firing, the speed and trajectory of the projectile will be adversely impacted.

The designs of the prior art attempt to solve this problem with the development of projectiles with a maximum diameter which is less than the diameter of the barrel which are rearwardly supported by a sabot having a diameter exceeding that of the barrel. While these saboted projectiles are desirable due to ease of loading operations, difficulties arise due to the reduced projectile diameter. Often, the projectile may not properly engage the barrel due to a loose or angled load. Due to the nature of the oversized sabot diameter, incorrectly loaded projectiles will provide the same or substantially similar tactile feedback to the operator during loading as correctly loaded projectiles. Incorrectly loaded projectiles which are subsequently fired can be especially dangerous, causing misfires, dramatically altered projectile trajectory, and overall reduced performance. Manufacturers of such designs attempt to remedy these disadvantages by requiring specific propellant charges to be used with these saboted projectiles or instructing operators to foul the barrel with soot and gunpowder residue prior to use. Thus, a need exists for a projectile system which can be fit within the barrel bore without the need to foul the barrel to ensure proper seating and firing operations.

SUMMARY OF THE INVENTION

Bearing in mind the problems and deficiencies of the prior art, it is therefore an object of the present invention to provide a firearm ammunition component which is easy and inexpensive to manufacture.

It is a further object of the present invention to provide a firearm ammunition component which is easy to load and remains central to a firearm barrel.

A further object of the present invention is to provide a firearm ammunition component which may be readily altered in size and weight to accommodate a plurality of firearm calibers.

Still other objects and advantages of the invention will in part be obvious and will in part be apparent from the specification.

The above and other objects, which will be apparent to those skilled in the art, are achieved in the present invention which is directed to a firearm ammunition component comprising a projectile body having a circular cross-section and a central channel on a forward face. A nose portion may be forward of the projectile body, and a gas check member may be rearward of the projectile body. The nose includes a curved forward end, a rear end opposite the forward end including a shank extending within the central channel, and a stabilizing element between the forward and rear ends extending radially outwards from a portion of the nose. The gas check member comprises an annular wall portion. The stabilizing element comprises a first outer diameter, and the body and the gas check member comprise a second outer diameter less than the first outer diameter. The stabilizing element may be adapted to contact a bore of a firearm, wherein the gas check member and body may be adapted to not contact the bore. The stabilizing element may comprise a stabilizing band disposed around the circumference of the nose.

In some embodiments, the firearm ammunition component may comprise a second stabilizing band disposed on the gas check member and extending radially outwards. The projectile body may further comprise a rounded forward end. The rounded forward end may be received within a hollow interior portion of the nose. A rearward end of the projectile body may include a tapered boat-tail portion, and the gas check member may include an upper annular wall for receiving the tapered boat-tail portion. An outer rim of the projectile body central channel may comprise a chamfered region.

The nose forward end may include a tip constructed of a material consisting of aluminum, lead, brass, copper, zinc, rubber, nylon, polyoxymethylene, polyester urethane-methylenebis(phenylisocyanate) copolymers, and combinations thereof.

The body may comprise a stem port on a rearward face and the gas check member may comprise a central stem or protrusion couplably engageable with the stem port. At least a portion of the firearm ammunition component may fragment upon ballistic impact. The shank may extend throughout the body and the gas check member may comprise a recess couplably engageable with the shank. The annular wall portion may comprise a resilient material which may expand to the first outer diameter upon ignition of a propellant charge within the bore.

The firearm ammunition component is adapted for use with a muzzleloader, or for use within a cartridge, air-gun, or shotgun.

The present invention also provides a firearm ammunition component, comprising a projectile body having a circular cross-section and a central channel on a forward face. The body comprises a rearward face with an annular wall portion enclosing a combustion chamber. A nose portion may be forward of the projectile body, having a curved forward end, a rear end opposite the forward end including a shank extending within the central channel, and a stabilizing element between the forward and rear ends extending radially outwards from a portion of the nose. The stabilizing band may comprise a first outer diameter, and the body may comprise a second outer diameter less than the first outer diameter. The stabilizing band may be adapted to contact a bore of a firearm, and the body may be adapted to not contact the bore. The stabilizing element may comprise a stabilizing band disposed around the circumference of the nose In one or more embodiments, an outer rim of the projectile body central channel includes a chamfered region. At least a portion of the firearm ammunition component may fragment upon ballistic impact. The annular wall portion may comprise a resilient material which is expandable to the first outer diameter upon ignition of a propellant charge in the bore. The firearm ammunition component may be adapted for use within a muzzleloader, a cartridge-based firearm, air-gun, or shotgun.

The present invention also provides a method of loading the firearm ammunition component of the embodiments described above within a launcher system. The method comprising providing the firearm ammunition component, providing a launcher system having a barrel with a muzzle end, placing the gas check member of the firearm ammunition component within the barrel, and moving the firearm ammunition component within the barrel such that only the stabilizing element/band contacts a barrel bore and centers the firearm ammunition component within the bore.

In some embodiments, the method further comprises the steps of igniting a propellant charge within a breech end of the barrel, and expanding the gas check member annular wall portion to contact the bore as a result of ignition of the propellant charge. The method may further include the steps of propelling, via the ignition of the propellant charge, the firearm ammunition component out of the muzzle end, and detaching the gas check member from the firearm ammunition component upon exiting the muzzle end. The launcher system may comprise a muzzleloader, a cartridge-based firearm, an air-gun, or a shotgun.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 22B depicts a side, cross-sectional view of the firearm ammunition component according to one embodiment of the present invention, shown within the firearm barrel during ballistic flight;

DESCRIPTION OF THE EMBODIMENT(S)

Figure 1:
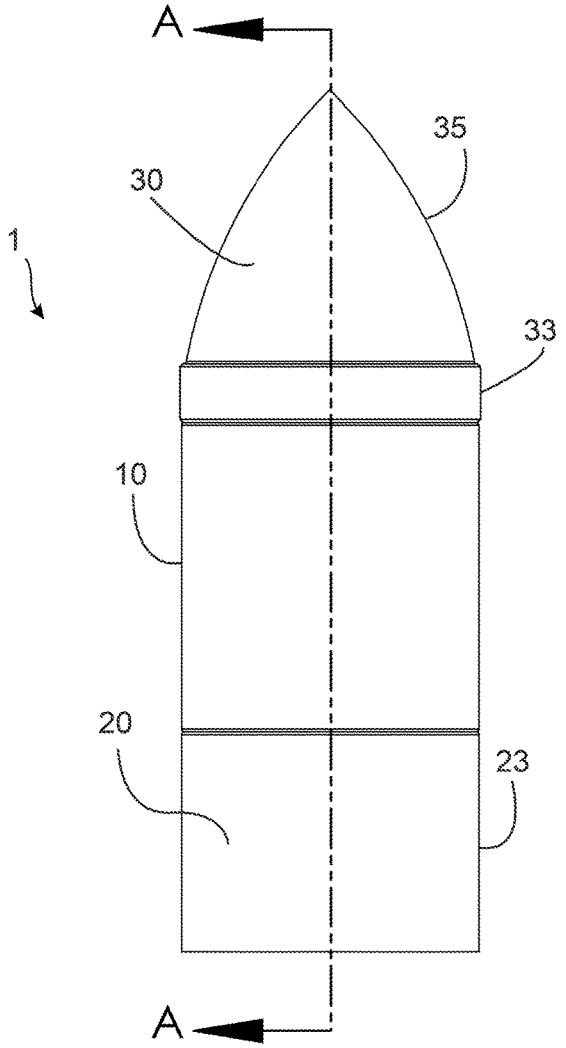
FIG. 1 depicts a side view of a firearm ammunition component according to one embodiment of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc., may be used herein to describe various components, these components should not be limited by these terms. These terms are only used to distinguish one component from another. For example, a first element could be termed a second element, and, similarly, a second element could be termed a first element, without departing from the scope of the present invention. As used herein, the singular forms "a", "an" and "the" are intended to include the plural forms as well, unless the context clearly indicates otherwise. Also, as used herein, the term "and/or" includes any and all combinations of one or more of the associated listed items. It will be further understood that the terms "include" and/or "including" when used herein, specify the presence of stated features, steps, operations, elements, and/or components, but do not preclude the presence or addition of one or more other features, steps, operations, elements, components, and/or groups thereof.

Relative terms such as "below," "above," "upper," "lower," "horizontal," "vertical," "top," "bottom," "rear," "front," "side," or the like may be used herein to describe a relationship of one element or component to another element or component as illustrated in the figures. It will be understood that these terms are intended to encompass different orientations of the device in addition to the orientation depicted in the figures.

Additionally, in the subject description, the words "exemplary," "illustrative," or the like are used to mean serving as an example, instance or illustration. Any aspect or design described herein as "exemplary" or "illustrative" is not necessarily intended to be construed as preferred or advantageous over other aspects or design. Rather, use of the words "exemplary" or "illustrative" is merely intended to present concepts in a concrete fashion.

In describing the embodiment of the present invention, reference will be made herein to FIGS. 1-26 of the drawings in which like numerals refer to like features of the invention.

The present invention provides a firearm ammunition component for use with firearms, including muzzleloaders, comprising a plurality of one-piece components. The firearm ammunition component according to the embodiments of the present invention are easier and less expensive to manufacture, and easier to load. The firearm ammunition component of the present invention allows for a true barrel-sized load, allowing for a more consistent, centered, muzzle end load. The firearm ammunition component comprises a projectile body which may be frangible, or designed of environmentally friendly (i.e., biodegradable or recyclable) materials. The firearm ammunition component can be modified to any suitable length by altering the dimensions of the projectile body. By way of these modifications, the stopping force of the firearm ammunition component can be modified as needed. The forward portion of the firearm ammunition component includes a stabilizing band or element which extends radially, and is adapted to contact the bore of a barrel during loading, while the remainder of the ammunition component does not contact the bore. In effect, the ammunition component will be centered to the barrel and the propellant charge, resulting in improved energy transfer from combustion products, while reducing the risk of improper load misfires.

With first reference to FIGS. 1-5, the firearm ammunition component 1 of the present invention generally comprises three components: nose segment 30, projectile body 10, and gas check member 20. Gas check member 20 comprises a generally cylindrical element constructed of a polymer and engineered for couplable engagement with nose shank 31. A projectile body 10 may be secured between nose 30 and gas check member 20 and may be sized to an outer diameter similar to that of gas check member 20. Preferably, the outer diameter of projectile body and gas check member is sized slightly less than that of a barrel bore, including the lands and grooves of the barrel rifling. Projectile body 10 may be constructed of a suitably solid, but deformable material such as lead, copper, aluminum, bismuth, lead alloys, copper alloys, plastic, other similar materials, and combinations thereof. In some embodiments projectile body may be frangible, breaking into smaller pieces after firing and/or impact. As depicted, projectile body comprises a circular cross-section, with a central channel 15 extending therethrough. In the embodiments shown in FIGS. 1-5, projectile body 10 comprises a flat forward portion 10*a* which provides a mating surface with a complementary inside surface 38 of nose 30, and a flat rearward portion 10*b* for providing a mating surface with the front forward surface 22 of the gas check member 20.

Nose 30 comprises a generally conical construction which includes a forward curved portion or ogive 35 and a flat, inside, lower surface 38 for engagement with projectile body 10. Nose 30 may be constructed of a sufficiently rigid material, such as ceramic, polymeric, or composite materials. A stabilizing band 33 is disposed on the full-diameter section of nose 30, forming a radially projecting circumferential surface around nose 30. In one embodiment, the stabilizing band includes a shelf or flat portion 37, although this is not meant to be limiting, and may also include a tapered or rounded transition from the surface of the nose 30 to the stabilizing band shoulder portion 37. Stabilizing band 33 and nose 30 may be molded together forming in a unitary construction, or separately welding, or bonding together using solvent, adhesive, spin-welding, vibration-welding, ultrasonic-welding or laser-welding techniques. Preferably, stabilizing band 33 comprises a material similar to nose 30, but other materials are not meant to be precluded.

Figure 4B:
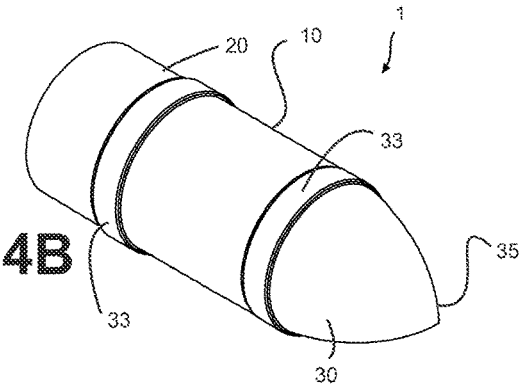
FIG. 4B depicts a perspective view of a firearm ammunition component according to one embodiment of the present invention
Figure 4A:
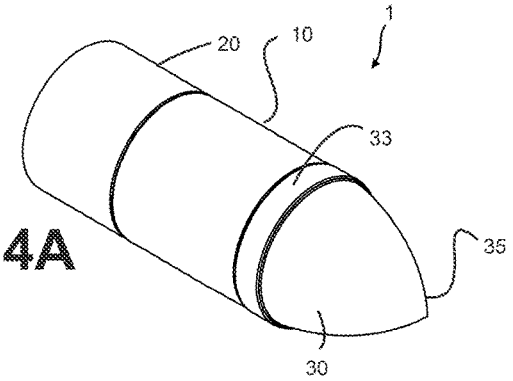
FIG. 4A depicts a perspective view of a firearm ammunition component according to one embodiment of the present invention.

Stabilizing band 33 may further include ribs or grooves along the outer surface of the band (not shown) which would reduce surface contact with the barrel bore when loaded, thus reducing frictional forces between the firearm ammunition component 1 and the bore during loading and firing operations. While the figures of the present embodiment depict the stabilizing band disposed on nose 30, other locations of the stabilizing band are not meant to be precluded. In some embodiments, the stabilizing band may be incorporated on the gas check member or both (FIG. 4B). Further, while only one stabilizing band is depicted, any number of stabilizing bands which would provide proper centering of the firearm ammunition component to the firearm barrel (as well as the propellant charge and/or primer) are not meant to be precluded.

Figure 24:
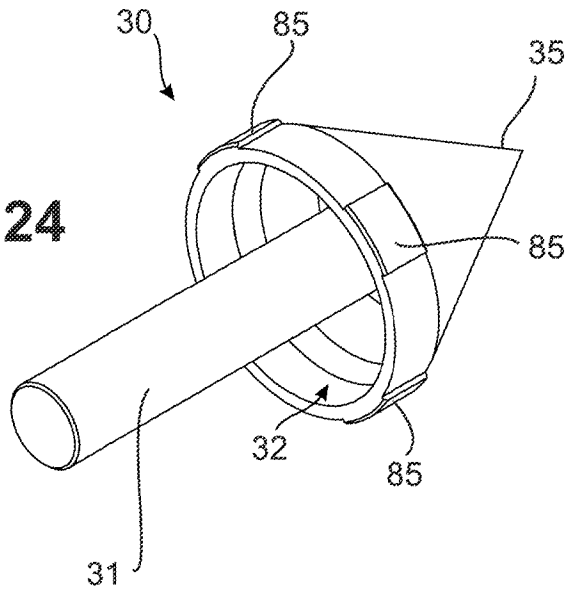
FIG. 24 depicts a perspective view of a portion of a firearm ammunition component according to one embodiment of the present invention.
Figure 25:
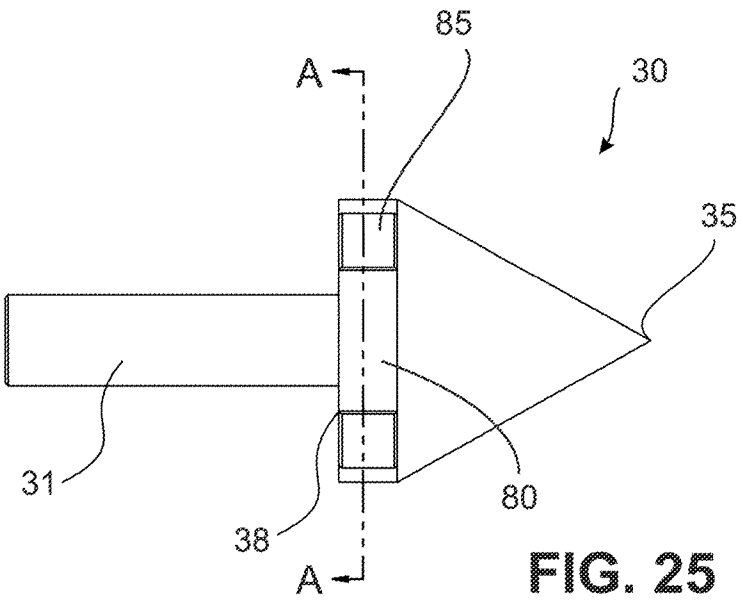
FIG. 25 depicts a side view of a portion of a firearm ammunition component according to one embodiment of the present invention.
Figure 26:
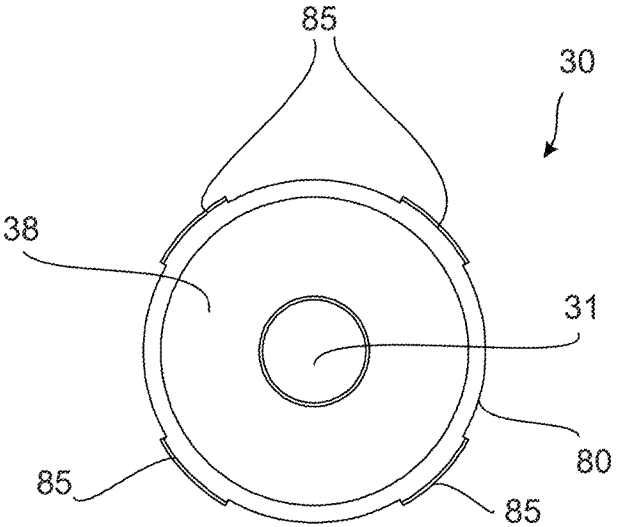
FIG. 26 depicts a side, cross-sectional view of the firearm ammunition component of FIG. 25, along lines A-A.

FIGS. 24-26 depict a firearm ammunition component nose displaying stabilizing elements 85 according to one or more embodiments of the present invention. The full-diameter section 80 or anywhere within the nose 30 may include one or more stabilizing elements 85 projecting from a portion of the nose surface. The number of stabilizing elements 85 will depend on the specific application and desired ballistic performance but may include 1, 2, 3, 4, 5, or more stabilizing elements. One embodiment includes four stabilizing elements 85 which may engage the barrel rifling, ensuring the firearm ammunition components remains co-axial to the barrel bore during loading and firing.

FIG. 25 depicts a perspective view of the nose 30 with one or more stabilizing elements 85 radially projecting from a portion of full-diameter section 80. The nose forward end 35 comprises a cone-like or V-shaped construction, but may alternately form a tangent ogive, secant ogive, hybrid ogive, and the like. The nose 30 may comprise a hollowed interior section 32 for complementary engagement with a rounded head projectile (See FIGS. 7 and 14-17). Alternately, and with additional reference to FIG. 26, nose 30 may comprise a flat inside surface 38 for mating with a complementary flat forward portioned projectile (See FIGS. 1-5, 8-12 and 18-21). Shank 31 may be disposed central to nose 30, projecting from the nose interior/inside surface and extending opposite nose forward end 35.

Figure 5:
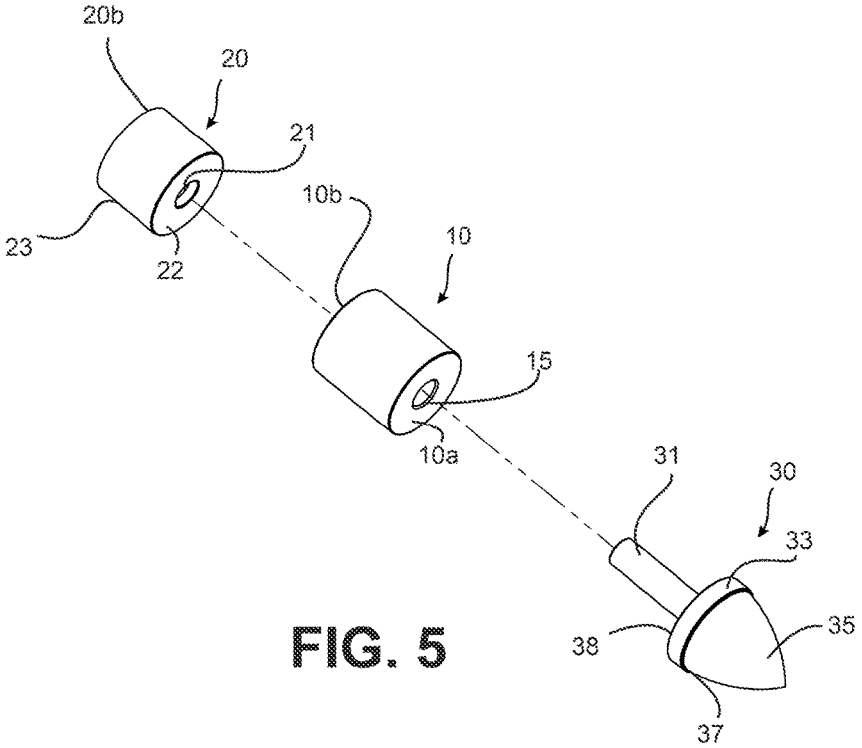
FIG. 5 depicts a perspective, exploded view of the firearm ammunition component of FIG. 4A.
Figure 6:
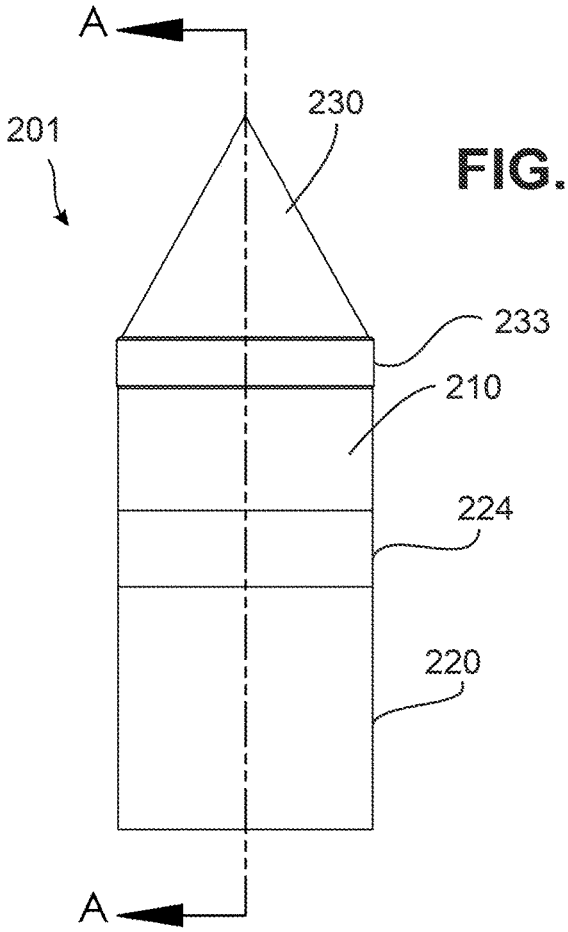
FIG. 6 depicts a side view of a firearm ammunition component according to one embodiment of the present invention.

Referring to FIG. 5, nose shank 31 extends centrally from nose inside surface 38, and may be sized to a diameter which slidably engages (by slip fit engagement, press fit engagement, and the like) central hollow channel 15 of projectile body 10. Shank 31 extends into at least a portion of central channel 15, and may extend beyond the projectile body rearward portion 10*b*. Shank 31 may be coupled to gas check member's forward surface 22 via central recess 21. Central recess 21 extends into at least a portion of the gas check member 20 interior, forming a depression or mortise to receive nose shank 31. Shank 31 may be coupled to recess 21 through press fit or snap-fit engagement or received by any other means which one or ordinary skill in the art could use, including an adhesive. In an alternative embodiment, shank 31 may be secured to projectile body 10 and not traverse into gas check member 20.

During assembly, shank 31 may be inserted within channel 15 and is sized to fit within and engage recess 21, creating an interference engagement between the gas check member 20 and the nose 30. Shank 31 may also be welded or bonded to the surface of gas check member 20 by solvent, adhesive, spin-welding, vibration-welding, ultrasonic-welding, or laser-welding techniques. Thus, shank 31 and recess 21 may be of any geometric construction which would facilitate connection between the nose 30 and gas check member 20 to ensure a sealing of projectile body 10 therebetween, such as a tapered tail and socket (dovetail) connection, threaded connection, stepped connection, and the like. Upon proper connection of shank 31 within recess 21, a tactile feedback may be produced. In some embodiments, such as those depicted in FIG. 2, a void 39 may result upon shank 31 has been coupled to the gas check member.

Figure 2:
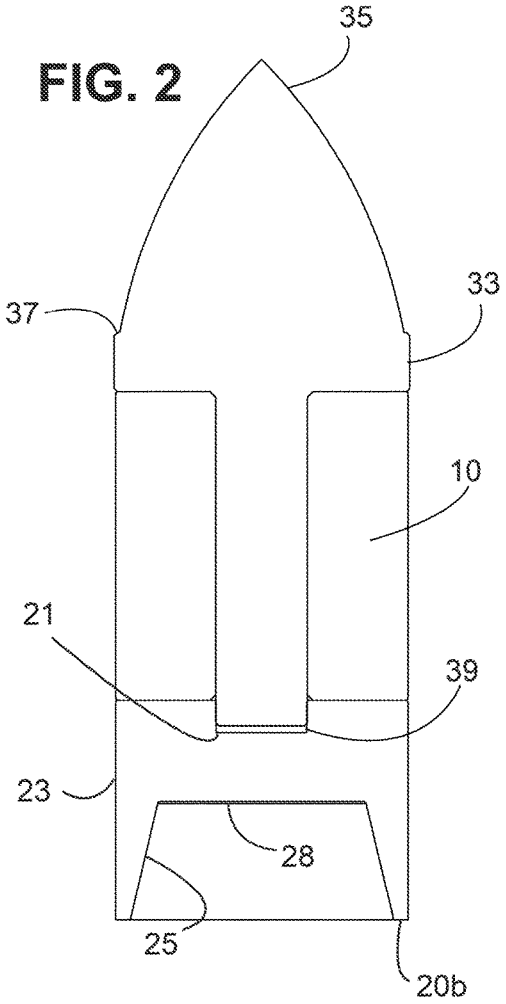
FIG. 2 depicts a side, cross-sectional view of the firearm ammunition component of FIG. 1, along lines A-A.
Figure 3:
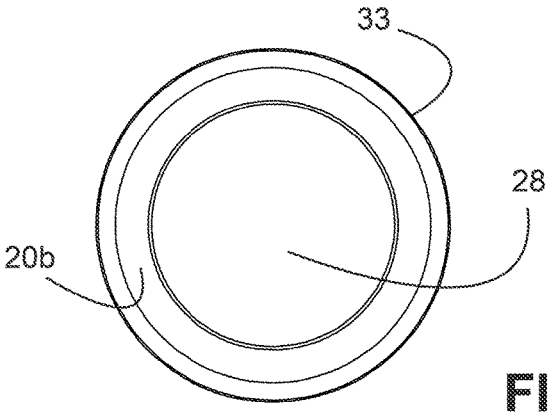
FIG. 3 depicts a bottom plan view of the firearm ammunition component according to one embodiment of the present invention.

Gas check member 20 comprises a generally cylindrical element, having a forward front face 22, and a rearward face 20*b* forming combustion chamber 28, An annular skirt comprising exterior skirt wall 23 and interior skirt wall 25 may extend between front face 22 and rearward rim 20*b*. The outer diameter of the gas check member may be similar to that of projectile body 10, forming a tolerance gap between the lands and grooves of the barrel interior and the exterior skirt wall 23 which would aid loading operations. As depicted in FIG. 2, interior skirt wall 25 is of an internally flared, stepped, or domed-shaped construction, causing the combustion chamber 28 to have a larger cross-sectional area at the end closest to rearward rim 20*b*, and a smaller cross-sectional area towards the front face 22 of the gas check member 20. While other geometries of the combustion chamber 28 are not meant to be precluded, the flared construction of the combustion chamber 28 is preferable, allowing the expansion of gases therewithin to push outwardly on the resilient material of the inner skirt wall 25, increasing the diameter of the exterior skirt wall 23 proximate rim 20*b*. In effect, gas check member 20 will deform via expansion within the barrel, ensuring combustion gases produced by the propellent charge will be applied to ignition forces of the firearm ammunition component. Advantageously, expansion of the gas check seals any tolerance gap between the firearm ammunition component and the barrel, achieving internal pressures necessary for acceptable ballistic performance.

Figure 22A:
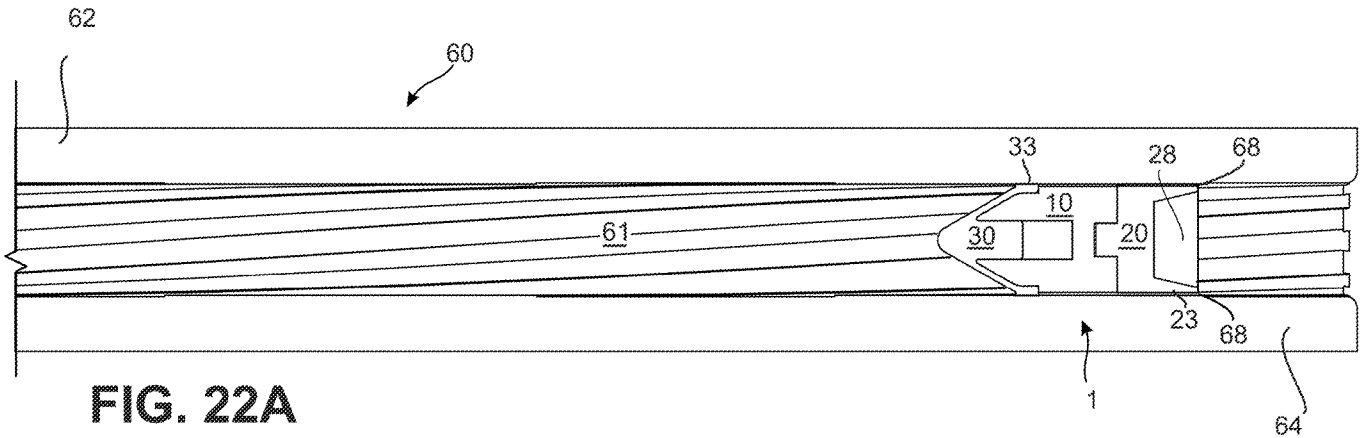
FIG. 22B depicts a side, cross-sectional view of a firearm ammunition component according to one embodiment of the present invention, shown within a firearm barrel.
Figure 22B:
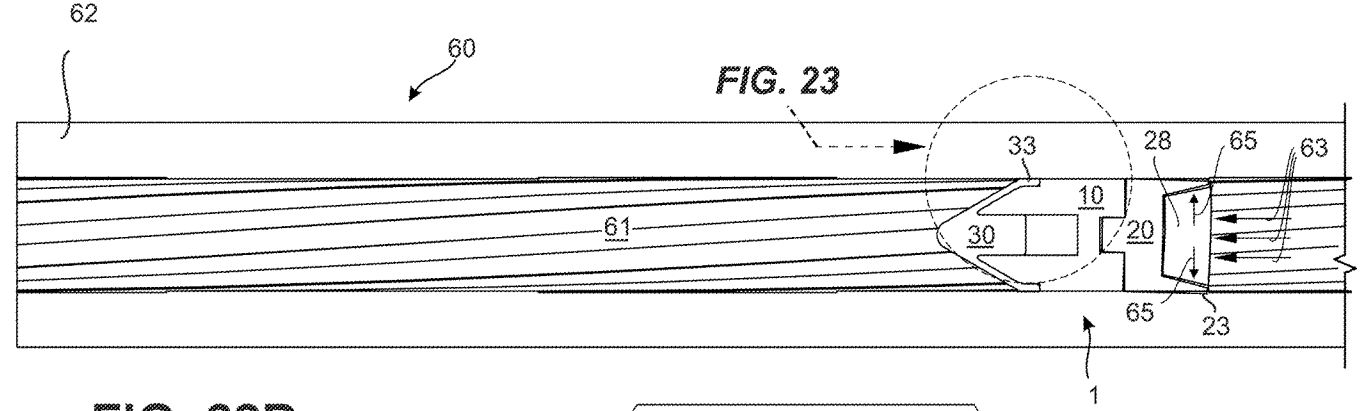
Figure 23:
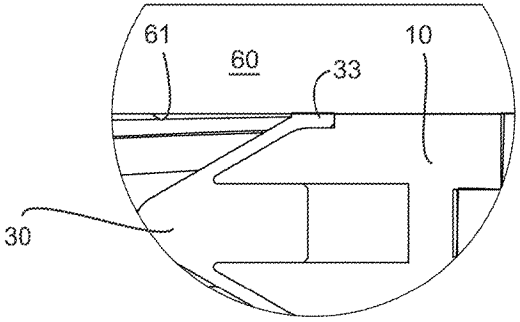
FIG. 23 depicts a side, cross-sectional view of a portion of the firearm ammunition component and firearm barrel according to one embodiment of the present invention.

Turning now to FIGS. 22A, 22B, and 23, the firearm ammunition component according to an embodiment of the present invention is depicted within a firearm barrel during ballistic flight. FIG. 22A depicts the firearm ammunition component 1 loaded within breech end 64 of barrel 60 and seated forward of a propellant charge (not shown). Once loaded, stabilizing band 33 of nose 30 will fit within and engage the rifling of bore 61 in an interference engagement, while projectile body 10 and gas check member 20 may be sized to form a transition or clearance engagement 68 with the bore 61. In some embodiments nose may comprise one or more stabilizing elements (not shown). Upon ignition of the propellant charge, gas pressure 63 will enter the combustion chamber 28 of the gas check member 20, forcing the firearm ammunition component 1 towards muzzle end 62 of the rifle (FIG. 22B). Expanding gas pressure within the combustion chamber 28 will cause the resilient exterior skirt wall 23 of gas check member 20 to expand outwardly in direction 65 to engage the rifle bore 61, preventing ingress of combustion products around the firearm ammunition component 1. Propulsive forces will propel the firearm ammunition component 1 through the barrel 60, engaging at least the stabilizing band 33 with the rifling of the bore 61 to provide spin before exiting the barrel muzzle 62 in ballistic flight. Advantageously, the stabilizing bands/elements of the firearm ammunition component engage the rifling of bore 61, ensuring the firearm ammunition component 1 remains co-axial to the barrel 64 during ballistic operations.

Alternate embodiments of the firearm ammunition component of the present invention described in detail below. The alternate embodiment(s) of the features of the firearm ammunition components described herein may be used in place of the firearm ammunition component elements described previously, and comparable features of the firearm ammunition component are numbered similarly, but with an increased magnitude (e.g., nose 30, 130, or 230). It should be understood by a person of skill in the art that one or more of the features described in the embodiment(s) below may be used in combination with other embodiments, including those described above.

Figure 11:
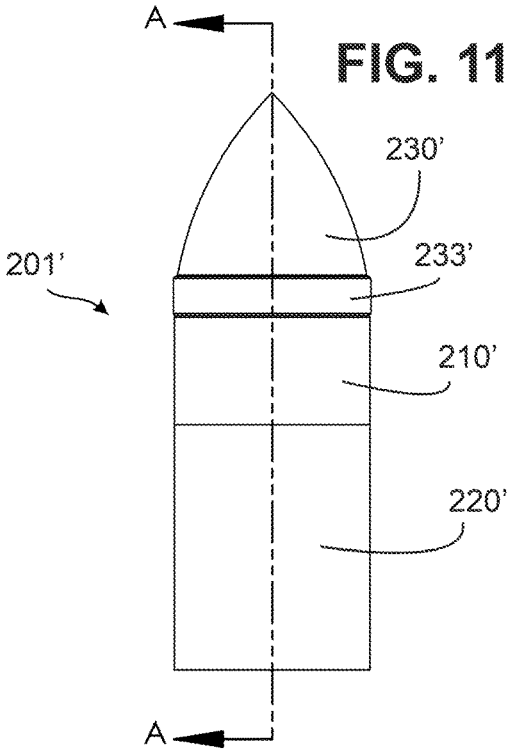
FIG. 11 depicts a side view of a firearm ammunition component according to one embodiment of the present invention.
Figure 12:
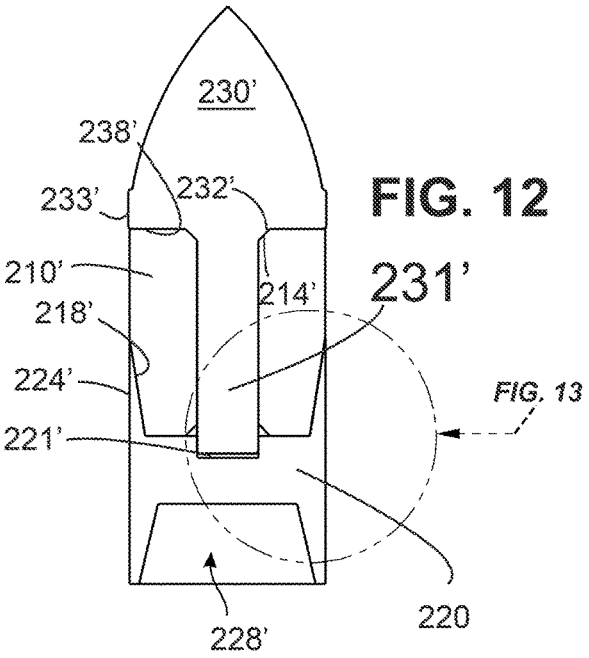
FIG. 12 depicts a side, cross-sectional view of the firearm ammunition component of FIG. 11, along lines A-A.
Figure 13:
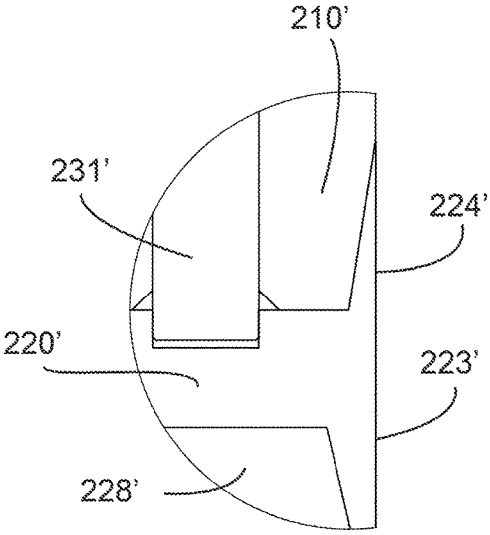
FIG. 13 depicts a side, cross-sectional view of a portion of the firearm ammunition component according to one embodiment of the present invention.
Figure 14:
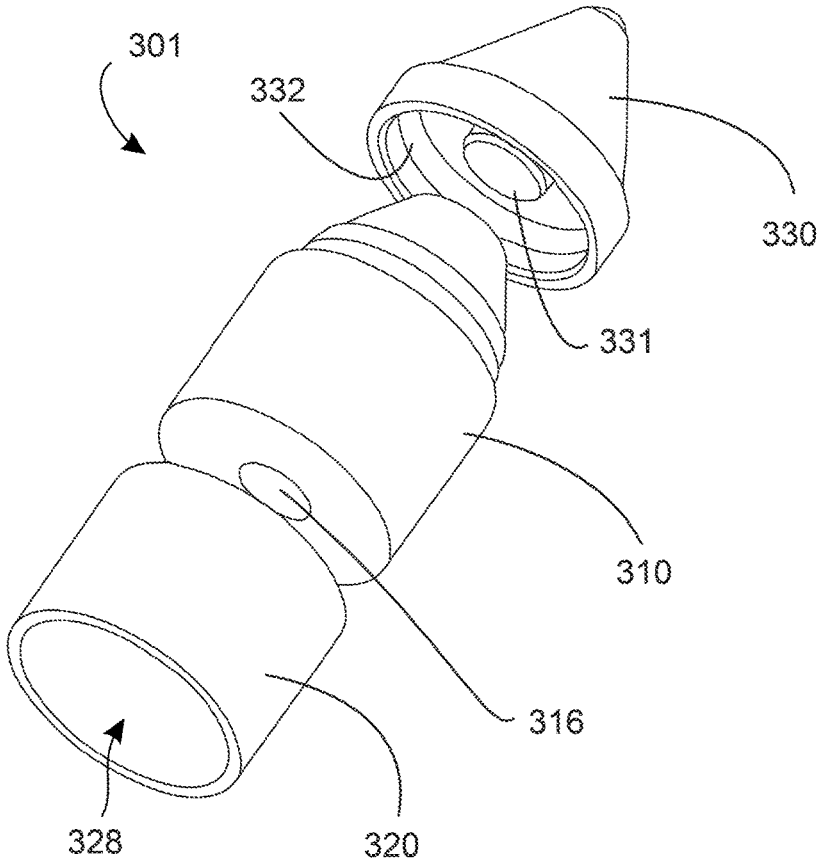
FIG. 14 depicts a perspective, exploded view of a firearm ammunition component according to one embodiment of the present invention.
Figure 15:
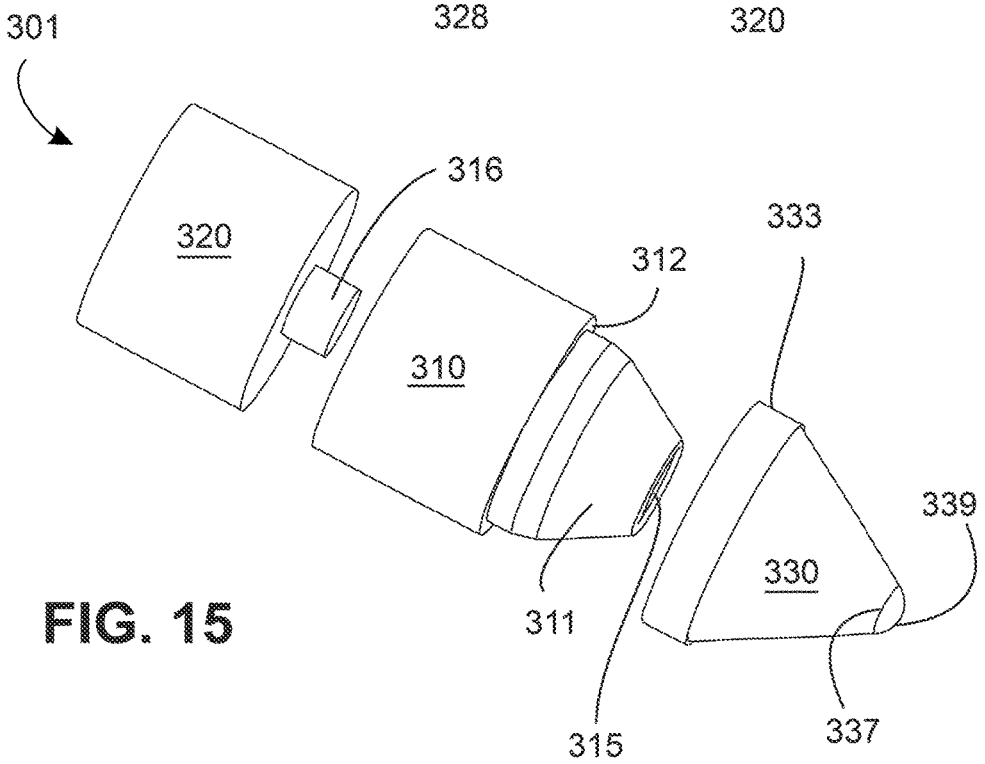
FIG. 15 depicts a perspective, exploded view of the firearm ammunition component according to one embodiment of the present invention.
Figure 16:
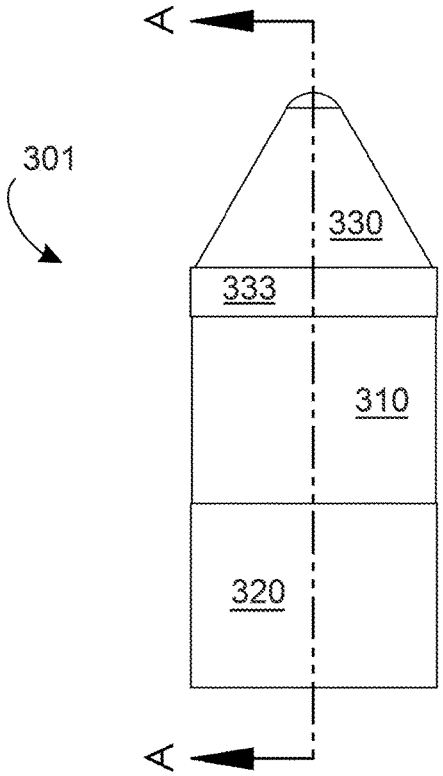
FIG. 16 depicts a side view of a firearm ammunition component according to one embodiment of the present invention.
Figure 17:
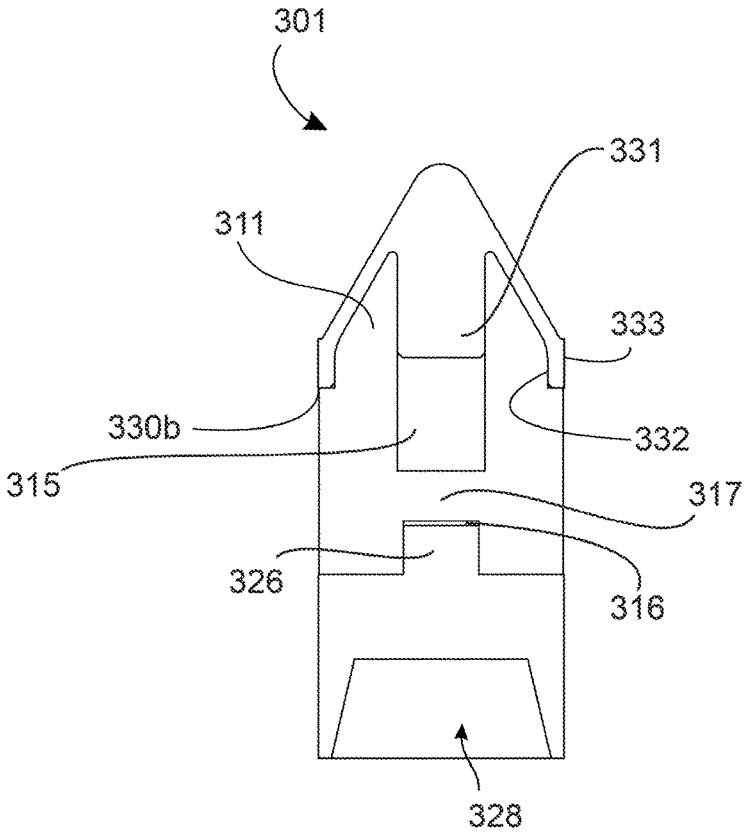
FIG. 17 depicts a side, cross-sectional view of the firearm ammunition component of FIG. 16, along lines A-A.

Turning to FIGS. 6, 7 and 11-13, an embodiment of the firearm ammunition component 201, 201' is shown, comprising nose/ogive 230, 230', which may a cone-like or V-shaped construction (See FIGS. 6 and 7), or may alternately form a tangent ogive, secant ogive, hybrid ogive, and the like (See FIGS. 11-13).

Figure 7:
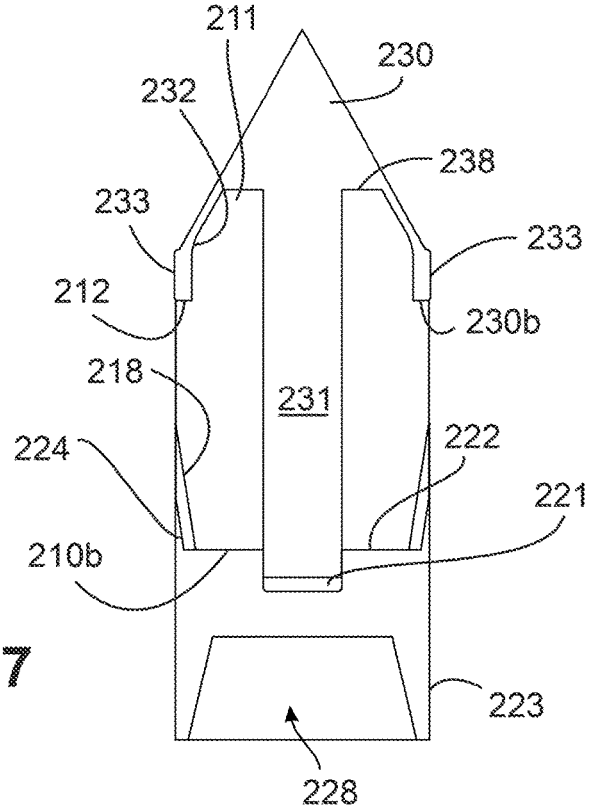
FIG. 7 depicts a side, cross-sectional view of the firearm ammunition component of FIG. 6, along lines A-A.
Figure 9:
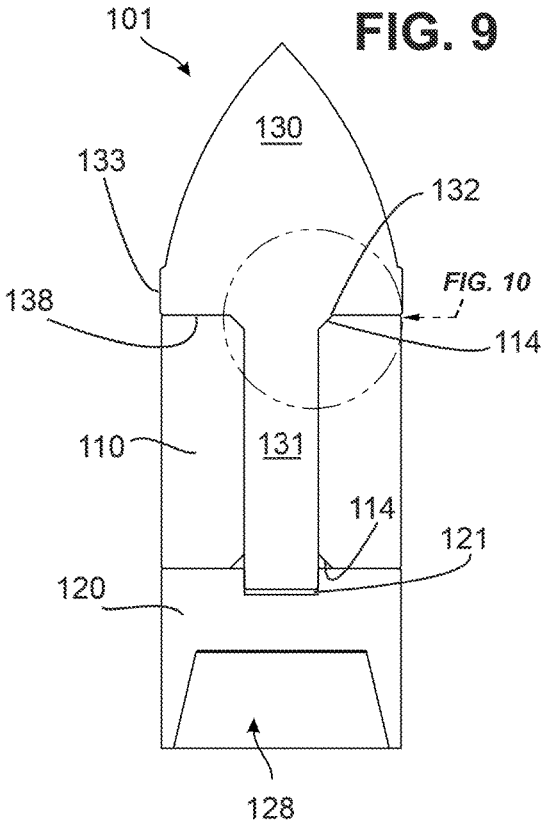
FIG. 9 depicts a side, cross-sectional view of the firearm ammunition component of FIG. 8, along lines A-A.
Figure 8:
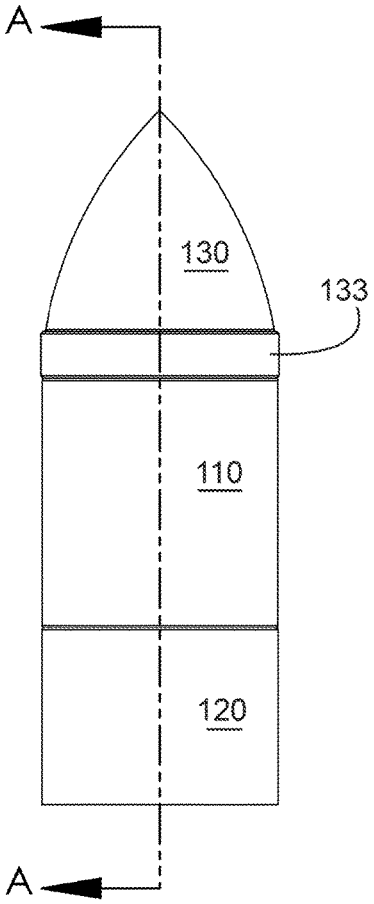
FIG. 8 depicts a side view of a firearm ammunition component according to one embodiment of the present invention.

With reference to FIGS. 7 and 14-17, the interior of the nose 230, 330 includes a hollowed section, starting at nose end 230*b*, 330*b*, forming an annular interior wall portion 232, 332 which may curve until terminating around flat inside surface 238 (FIG. 7). Shank 231, 331 may be disposed central to nose 230, 330, projecting from the nose interior and extending towards the rearward end of the firearm ammunition component 201, 301. As depicted, stabilizing band 233, 333 is disposed on the full-diameter section of nose 230, 330 proximate end 230*b*, 330*b*. Instead of the circumferential stabilizing band 233, 333, the full-diameter section or elsewhere on the surface of the nose 230, 330 may include one or more stabilizing elements (not shown) projecting from a portion of the nose surface. The number of stabilizing elements will depend on the specific application and desired ballistic performance but may include 1, 2, 3, 4, 5, or more stabilizing elements. In either configuration, the stabilizing band/element(s) will engage the barrel rifling, ensuring the firearm ammunition component remains coaxial to the barrel at all stages of ballistic operation.

The forward portion of projectile body 210, 310 includes a stepped shoulder 212, 312 and rounded head 211, 311 surrounding channel 215, 315 for complementary engagement with nose interior wall 232, 332. Rounded head 211, 311 provides increased frangibility, influencing fragmentation upon ballistic impact of the firearm ammunition component, (i.e., through deformation of body 210, 310), similar to a "mushroom tip" or "hollow point" rounds. The forward end 211, 311 of projectile body 210, 310 may be further modified to provide different overall lengths of the firearm ammunition component, thereby providing different weight modifications as necessary to improve performance and seating of the firearm ammunition component.

Turning now to FIGS. 14-17, projectile body 310 comprises nose channel 315 on the forward end of the body, extending only through a portion of the body interior. Body rearward or breech end comprises a stem port 316 which extends into a portion of the body. Nose 330 may further comprise a forward end 337, which may include a tip 339. Tip 339 forms the nose meplat, and may include a variable diameter and uniformity to provide further aerodynamic efficiency of the firearm ammunition component 301. Tip 339 may be constructed of a material such as aluminum, lead, brass, copper, zinc, rubber, nylon, plastics such as polyoxymethylene, polyester urethane-methylenebis(phenylisocyanate) copolymers, and other similar alternatives.

Gas check member 320 may include a central stem or protrusion 326 opposite the gas check member end having combustion chamber 328. Stem 326 is sized to fit within and engage stem port 316, creating an interference engagement between the gas check member 320 and the projectile body 310. Stem 326 may also be insertable within stem port 316 for couplable engagement with projectile body 310 by adhesive fitting, welding or bonding together using solvent, adhesive, spin-welding, vibration-welding, ultrasonic-welding or laser-welding techniques. Projectile body 310 between stem port 316 and channel 315 comprises a core 317, allowing the adjustment of the size, shape, and material forming body 310, allowing various body lengths and weights without need to alter the nose 330 and gas check 320.

With reference again to FIGS. 6, 7 and 11-13, lower portion or base of projectile body 210, 210' may be stepped or tapered towards rearward end 210*b* of the projectile body, forming boat-tail 218,218', which may be encased by a gas check upper annular wall 224, 224', which may be cast integrally with gas check member 220, 220°, or adhered to the gas check member 220 using adhesives, welding, and the like. The interior of annular wall 224, 224' which encases the projectile body may be sloped, though other design schemes are not meant to be precluded. Annular wall 224, 224' may include grooves, ridges, and the like on its interior, creating a snap-fit or press-fit connection with the projectile body 210, 210'. In addition, body 210, 210° and gas check 220, 220' may be welded or bonded together using solvent, adhesive, spin-welding, vibration-welding, ultrasonic-welding or laser-welding techniques.

During firing operations gas check 220, 220' may be designed to release from the projectile body 210, 210° after leaving the barrel muzzle. Advantageously, boat tail 218, 218° of the projectile body 210, 210° provides improved aerodynamics during the projectile's trajectory, increasing the projectile body 210, 210° accuracy, velocity, and stability during ballistic performance.

Figure 10:
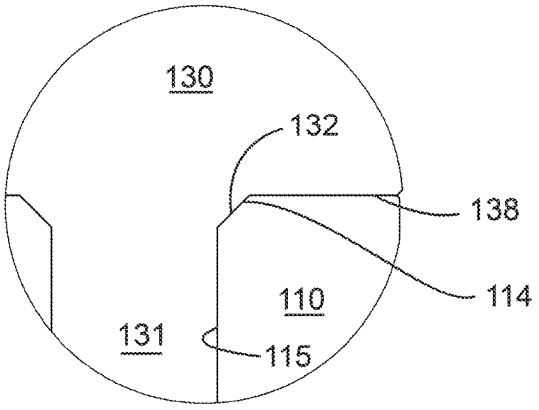
FIG. 10 depicts a side, cross-sectional view of a portion of the firearm ammunition component according to one embodiment of the present invention.

In another embodiment, the firearm ammunition component may incorporate a chamfered design to vary expansion of the projectile body, as depicted in FIGS. 8-10 and 11-13. As shown in the cross-sectional view of FIG. 9, shank 131, 231' of nose 130 may include an angled extension portion 132, 232° between flat bottom portion 138, 238° and base or forward portion of shank 131, 231'. A complementary chamfered region 114, 214' may be disposed on the outer rim of the body central channel 115, 215'. As depicted in FIG. 10, body chamfer 115, 215° is received by nose angled extension portion 132, 232°, creating an integral connection between the nose 130, 230' and the projectile body 110, 210'. Chamfers 114, 214' and angled extension portion 132, 232' are advantageous in that after firing of the firearm ammunition component, angled extension portion 132, 232' may produce expansion of projectile body 110, 210' to influence fragmentation upon ballistic impact. Thus, chamfers 114, 214' and angled extension portion 132, 232' may be of any angle or size which is necessary to produce the particular projectile body fragmentation upon ballistic impact. Likewise, the diameter of shank 131, 231' and channel 115, 215' may be adjusted as necessary, particularly when it is necessary to increase/decrease projectile body to alter the overall weight of the firearm ammunition component.

Turning now to FIGS. 18-21, fire ammunition component 401 comprises a nose 430 with stabilizing band 433 and a combined projectile body/gas check component 450. Instead of the circumferential stabilizing band 433, the full-diameter section or elsewhere on the surface of the nose 430 may include one or more stabilizing elements (not shown) projecting from a portion of the nose surface. The number of stabilizing elements will depend on the specific application and desired ballistic performance but may include 1, 2, 3, 4, 5, or more stabilizing elements. In either configuration, the stabilizing band/element(s) will engage the barrel rifling, ensuring the firearm ammunition component remains coaxial to the barrel at all stages of ballistic operation.

Figure 18:
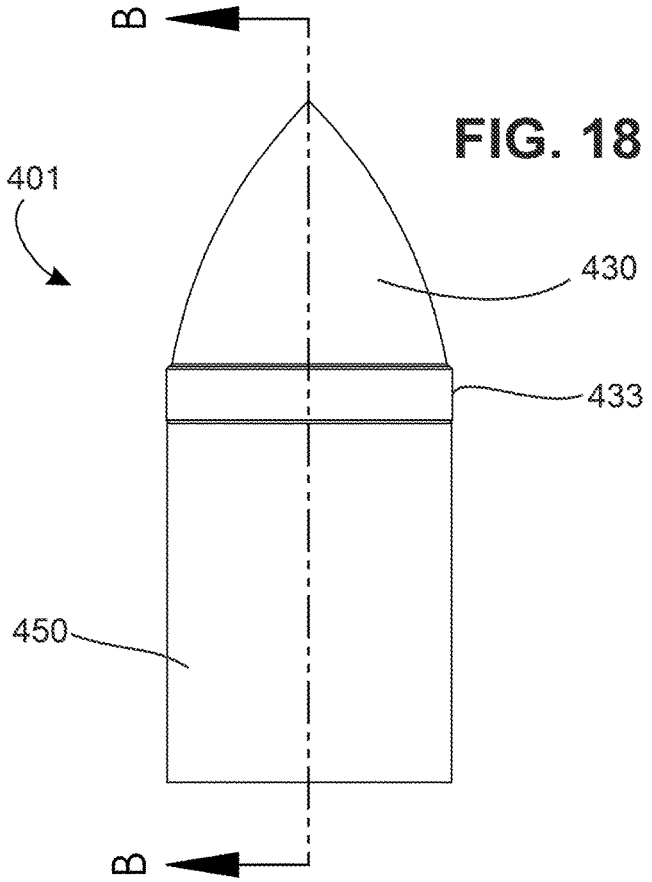
FIG. 18 depicts a side view of a firearm ammunition component according to one embodiment of the present invention.
Figure 19:
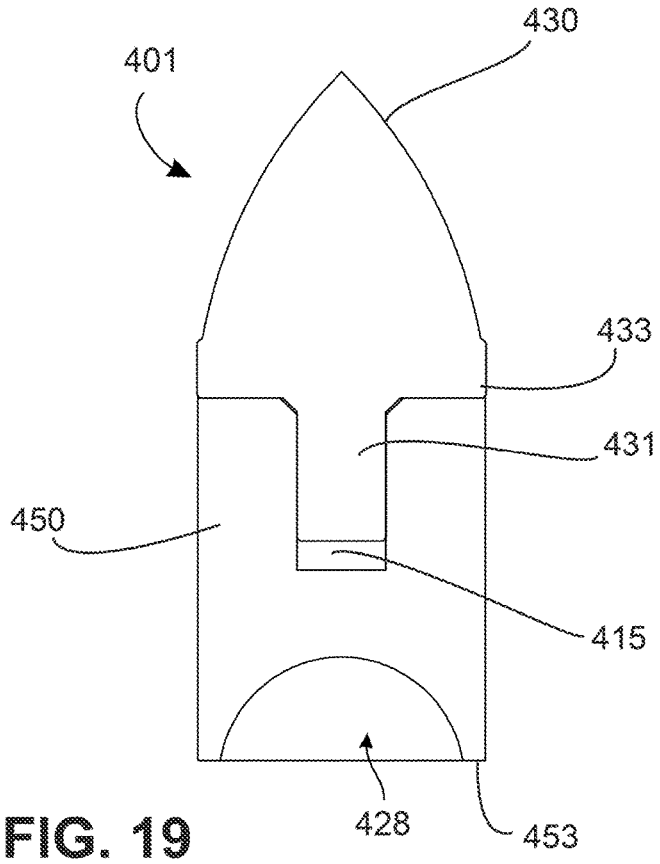
FIG. 19 depicts a side, cross-sectional view of the firearm ammunition component of FIG. 18, along lines B-B.
Figure 20:
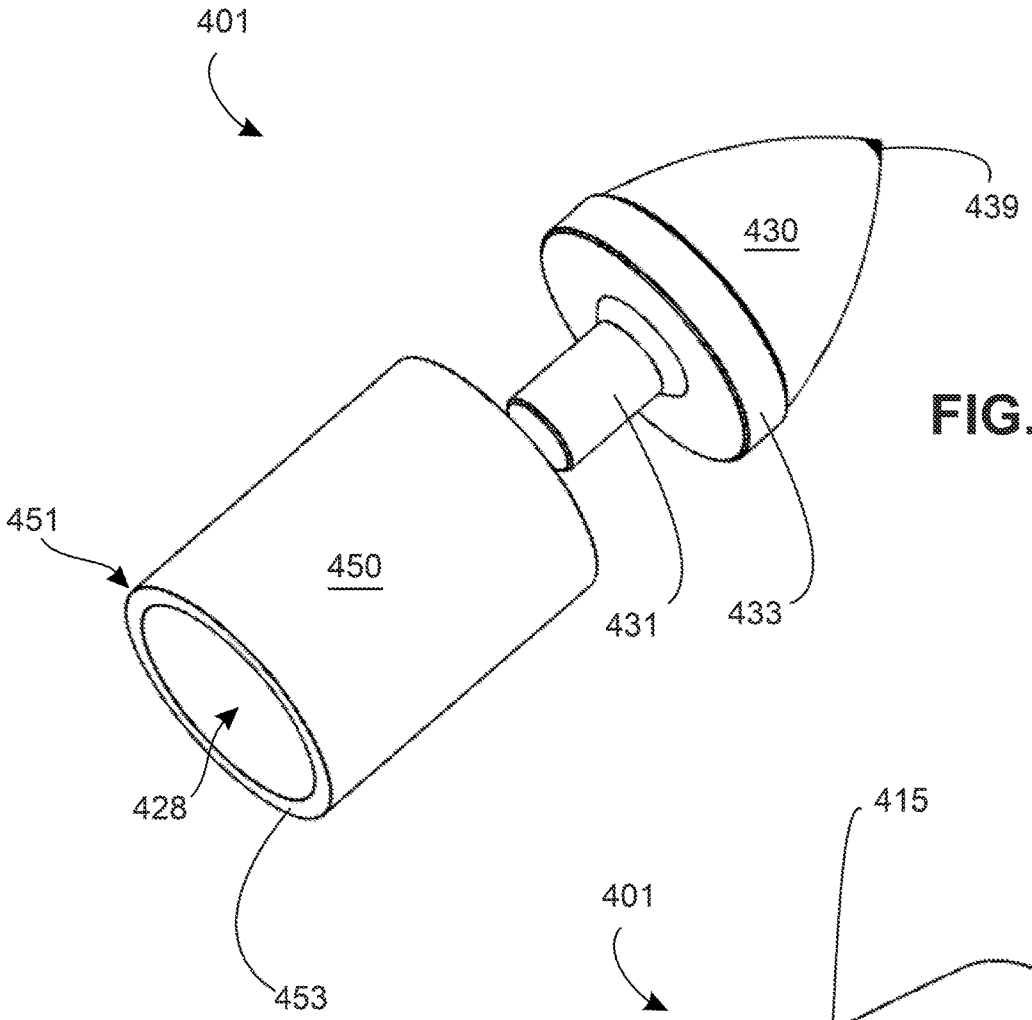
FIG. 20 depicts a perspective, exploded view of a firearm ammunition component according to one embodiment of the present invention.
Figure 21:
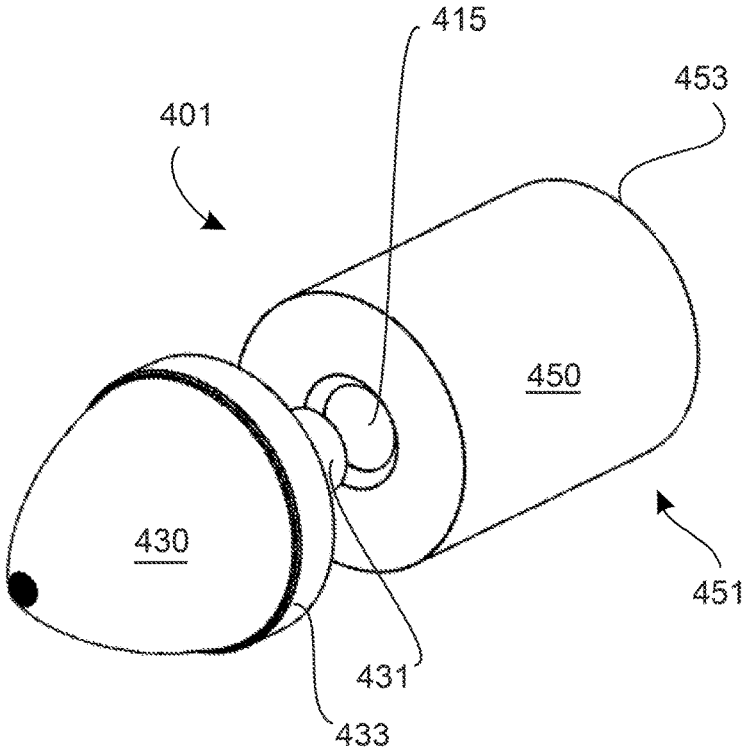
FIG. 21 depicts a perspective, exploded view of the firearm ammunition component according to one embodiment of the present invention.

Nose 430 depicted in FIG. 18 comprises a cone-like or V-shaped construction, though other ogive and rounded/flat meplat constructions are not meant to be precluded, as nose 430 may form a tangent ogive, secant ogive, hybrid ogive, and the like. The combined body/gas check component 450 includes a channel 415 extending through a portion of the element interior. Nose shank 431 may be inserted within channel 415 and is sized to fit within and engage component 450, creating an interference engagement between the nose 430 and the combined body/gas check component 450. Nose shank 431 may also be fitted to component 450 by adhesive fitting, welding or bonding together using solvent, adhesive, spin-welding, vibration-welding, ultrasonic-welding or laser-welding techniques. Component rearward end 451 includes combustion chamber 428 which is surrounded by a rim 453. Similar to the gas check members of the previous embodiments, rim 453 may deform and expand to contact the barrel interior to encapsulate combustion products formed after ignition of the propellant charge. Nose tip 439 may be constructed of a material such as aluminum, lead, brass, copper, zinc, rubber, nylon, and plastics such as polyoxymethylene, polyester urethane-methylenebis(phenylisocyanate) copolymers, and other similar alternatives.

The increased diameter of stabilizing band(s) 33, 133, 233, 233', 333, 433 and the stabilizing element(s) 85 compared to the outer diameter of the remainder of the firearm ammunition component assists in convenient loading of the firearm ammunition component within a barrel, while still providing enough contact with the inside of the barrel bore to hold the firearm ammunition component in the barrel during handling and hunting. The stabilizing band(s) 33, 133, 233, 233', 333, 433 and the stabilizing element(s) 85 are adapted to contact a bore of a firearm, providing an interference engagement between the firearm ammunition component and the bore, while gas check member 20, 120, 220, 220', 320 and/or body 10, 110, 210, 210', 310, 450 are adapted not to contact the bore, resulting in a transition or clearance fit. Thus, the ease of loading operations will be ensured even after the barrel has been fouled by repeated firing.

The embodiments of the present invention may be designed so that upon exiting the barrel, the gas check member 20, 120, 220, 220', 320, and in some embodiments body 450, may disengage, break off, and/or detach from nose shank 31, 131, 231, 231°, body 310, or shank 431, respectively. With or without disengagement of the gas check member, upon exiting the barrel the firearm ammunition component will continue, unimpeded, toward the target. Upon ballistic impact, nose 30, 130, 230, 230', 330, 430 will impart pressure forces necessary to penetrate the target. Upon entry with the target, body 10, 110, 210, 210', 310, 410 will impart forces necessary to provide stopping power of firearm ammunition component. In some embodiments, nose 30, 130, 230, 230', 330, 430 may disengage, detach, or break off from the projectile body upon ballistic impact to allow a particularized fragmentation upon ballistic impact. The rate of expansion for the projectile body 10, 110, 210, 210', 310, 410 may vary depending on the size, mass, and propellant charge load of the firearm ammunition component. While the firearm ammunition component of the present invention is preferable for use with muzzleloading firearms, other firearm applications for the firearm ammunition component are not meant to be precluded. For example, the firearm ammunition component of the present invention could be used for air-guns, or even shotguns, and further modifications are not meant to be precluded to enable usage of the firearm ammunition component within modern cartridge-based ammunition components.

Thus, the present invention provides one or more of the following advantages: providing a firearm ammunition component which is easier and less expensive to manufacture. Providing a firearm ammunition component which is easy to load, particularly when used in tandem with a muzzleloading firearm. The firearm ammunition component of the present invention allows for a barrel-sized load, allowing for a more consistent front muzzle load. The projectile body may be frangible, or designed of environmentally friendly (i.e., biodegradable or recyclable) materials as opposed to projectile body constructions of heavy metals such as lead. The firearm ammunition component can be modified to create a projectile of any suitable length by altering the shank and projectile body length. In addition, the diameter of the projectile body channel and nose shank can be modified to alter the weight of the projectile body and thus the stopping force which will be imparted onto a target. Similarly, due to the configuration of the stabilizing band/elements, the firearm ammunition component will result in a load which is centered to the barrel and propellant charge, resulting in improved energy transfer from combustion products. Thus, the present invention provides a firearm ammunition component which maintains proper alignment within the barrel during internal ballistic operations, reducing the risk of improper load misfire.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A firearm ammunition component, comprising:

a projectile body having a circular cross-section and a central channel on a forward face;

a nose portion forward of the projectile body, said nose portion having a shank extending in a rearward direction of said nose portion into said central channel of said projectile body;

a gas check member rearward of the projectile body, having a rearward facing combustion chamber, and a forward-facing central recess extending into a portion of said gas check member interior, forming a depression or mortise to receive said shank, such that said recess is couplably engageable with said shank, and said shank is not exposed to said combustion chamber;

the nose having a curved forward end, a rear end opposite the forward end, and a stabilizing element between the forward and rear ends extending radially outwards from a portion of the nose;

the gas check member having an annular wall portion;

wherein the stabilizing element forms a unitary construction with said nose portion, and comprises a first outer diameter, and the projectile body and the gas check member comprise a second outer diameter less than the first outer diameter, wherein the stabilizing element is adapted to contact a bore of a firearm, wherein at least one of the gas check member and projectile body are dimensioned to not contact said bore during loading.

2. The firearm ammunition component of claim 1 comprising a stabilizing band circumferentially disposed on the gas check member and extending radially outwards.

3. The firearm ammunition component of claim 1 wherein the projectile body further comprises a rounded forward end.

4. The firearm ammunition component of claim 3 wherein the rounded forward end is received within a hollow interior portion of the nose.

5. The firearm ammunition component of claim 1 wherein a rearward end of the projectile body includes a tapered boat-tail portion.

6. The firearm ammunition component of claim 5 wherein the gas check member includes an upper annular wall for receiving the tapered boat-tail portion.

7. The firearm ammunition component of claim 1 wherein an outer rim of the projectile body central channel includes a chamfered region.

8. The firearm ammunition component of claim 1 wherein the nose forward end includes a tip constructed of a material consisting of aluminum, lead, brass, copper, zinc, rubber, nylon, polyoxymethylene, polyester urethane-methylenebis (phenylisocyanate) copolymers, or combinations thereof.

9. The firearm ammunition component of claim 1 wherein the projectile body comprises a stem port on a rearward face and wherein the gas check member comprises a central stem or protrusion couplably engageable with the stem port.

10. The firearm ammunition component of claim 4 wherein at least a portion of the projectile body fragments upon ballistic impact.

11. The firearm ammunition component of claim 1 wherein the shank is welded or bonded to said forward facing central recess of said gas check member by solvent, adhesive, spin-welding, vibration-welding, ultrasonic-welding, or laser-welding techniques.

12. The firearm ammunition component of claim 1 wherein the stabilizing element comprises a stabilizing band disposed around the circumference of the nose.

13. The firearm ammunition component of claim 1, wherein the firearm ammunition component is adapted for use within a cartridge-based firearm, muzzleloader, air-gun, or shotgun.

14. A firearm ammunition component, comprising:

a projectile body having a circular cross-section and a central channel on a forward face;

the projectile body having a rearward face with an annular wall portion forming a combustion chamber;

a nose portion forward of the projectile body;

the nose portion having a curved forward end, a rear end opposite the forward end including a shank extending within the central channel in a rearward direction, and a stabilizing element between the forward and rear ends extending radially outwards from a portion of the nose;

a gas check member rearward of the projectile body, having a rearward facing combustion chamber, and a forward-facing central recess extending into a portion of said gas check member interior, forming a depression or mortise to receive said shank, such that said recess is couplably engageable with said shank, and said shank is not exposed to said combustion chamber;

said combustion chamber having an inner skirt wall composed of resilient material with flared construction extending radially outwards at a rearward facing end, allowing expansion of gases therewithin to push outwardly on said resilient material of said inner skirt wall;

wherein the stabilizing element forms a unitary construction with said nose portion, and comprises a first outer diameter, and the body comprises a second outer diameter less than the first outer diameter, wherein the stabilizing element is dimensioned to contact a bore of a firearm, wherein the body is dimensioned to not contact said bore during loading.

15. The firearm ammunition component of claim 14 wherein an outer rim of the projectile body central channel includes a chamfered region.

16. The firearm ammunition component of claim 14 wherein at least a portion of the projectile body fragments upon ballistic impact.

17. The firearm ammunition component of claim 14 wherein the stabilizing element comprises a stabilizing band disposed around the circumference of the nose.

18. The firearm ammunition component of claim 14, wherein the firearm ammunition component is adapted for use within a muzzleloader.

19. The firearm ammunition component of claim 14, wherein the firearm ammunition component is adapted for use within a cartridge-based firearm, air-gun, or shotgun.

20. A method of loading a firearm ammunition component within a launcher system, the method comprising:

providing the firearm ammunition component comprising:

a projectile body having a circular cross-section and a central channel on a forward face, a nose portion forward of the projectile body, a gas check member rearward of the projectile body, having a rearward facing combustion chamber, and a forward-facing central recess extending into a portion of said gas check member interior, forming a depression or mortise to receive said shank, such that said recess is couplably engageable with said shank, and said shank is not exposed to said combustion chamber, the nose portion having a curved forward end, a rear end opposite the forward end including a shank extending within the central channel in a rearward direction, and a stabilizing element between the forward and rear ends extending radially outwards from a section of the nose portion, and the gas check member having an annular wall portion with radially outward flared construction at a rearward facing end, allowing expansion of gases therewithin to push outwardly on said annular wall;

providing a launcher system having a barrel with a muzzle end;

placing, initially, the gas check member of the firearm ammunition component within a muzzle end of the barrel; and moving, subsequently, the firearm ammunition component within the barrel such that the stabilizing element contacts a bore of the barrel and centers the firearm ammunition component within the bore;

wherein upon insertion the gas check member and projectile body do not contact the bore.

21. The method of claim 20, further comprising the steps of:

igniting a propellant charge within a breech end of the barrel; and expanding the gas check member annular wall portion to contact the bore as a result of ignition of the propellant charge.

22. The method of claim 21, further comprising the steps of:

propelling, via the ignition of the propellant charge, the firearm ammunition component out of the muzzle end; and detaching the gas check member from the firearm ammunition component upon exiting the muzzle end.

23. The method of claim 20, wherein the launcher system comprises a muzzleloader.

24. The method of claim 20, wherein the launcher system comprises a cartridge-based firearm, air-gun, or shotgun.

25. A firearm ammunition component adapted for use with a muzzleloader, comprising:

a projectile body having a circular cross-section and a central channel on a forward face;

a nose portion forward of the projectile body;

a gas check member rearward of the projectile body having a combustion chamber;

the nose having a curved forward end, a rear end opposite the forward end including a shank extending within the central channel, and a stabilizing element between the forward and rear ends extending radially outwards from a portion of the nose;

the gas check member having an annular wall portion with radially outward flared construction at a rearward facing end, forming said combustion chamber, said flared construction allowing expansion of gases therewithin to push outwardly on said annular wall;

wherein the stabilizing element forms a unitary construction with said nose portion, and comprises a first outer diameter, and the projectile body and the gas check member comprise a second outer diameter less than the first outer diameter, wherein the stabilizing element is adapted to contact a bore of the muzzleloader, wherein at least one of the gas check member and projectile body are dimensioned to not contact said bore during loading.

26. The firearm ammunition component of claim 1, wherein said gas check member includes an interior skirt wall having an internally flared, stepped, or domed-shaped construction, causing the combustion chamber to have a larger cross-sectional area at the end closest to a rearward rim, and a smaller cross-sectional area towards a front face of said gas check member.

* * * * *